United States Patent [19]

Van Trump

[11] Patent Number: 4,921,900

[45] Date of Patent: May 1, 1990

[54] STABLE SOLUTIONS OF POLY(PARAPHENYLENE TEREPHTHALAMIDE) ACID CRUMB

[75] Inventor: James E. Van Trump, Wilmington, Del.

[73] Assignee: E. I. Du Pont De Nemours and Company, Wilmington, Del.

[21] Appl. No.: 284,423

[22] Filed: Dec. 14, 1988

[51] Int. Cl.[5] ..... C08L 79/00

[52] U.S. Cl. ..... 524/744; 524/84; 524/173; 524/386; 524/391; 524/589; 524/606; 524/608; 524/742; 524/751; 524/767; 528/348

[58] Field of Search ..... 524/744, 742, 751, 767, 524/84, 173, 386, 391, 589, 606, 608; 528/348

[56] References Cited

U.S. PATENT DOCUMENTS

| | | | |
|---|---|---|---|
| 2,999,788 | 9/1961 | Morgan | 162/146 |
| 3,869,429 | 3/1975 | Blades | 260/785 |
| 4,016,236 | 4/1977 | Nagasawa et al. | 264/184 |
| 4,308,374 | 12/1981 | Vollbracht et al. | 528/336 |
| 4,785,038 | 11/1988 | Sweeny | 524/173 |

*Primary Examiner*—Harold D. Anderson

[57] ABSTRACT

The acidic crumb of poly(paraphenylene terephthalamide) formed from the reaction of terephthaloyl chloride with para-phenylene diamine in an N-alkyl-pyrrolidone with an alkali or alkaline earth metal salt, is dissolved in a defined mixture of a base, a solvent and co-solvent for use in the direct preparation of fibrous products.

8 Claims, No Drawings

STABLE SOLUTIONS OF POLY(PARAPHENYLENE TEREPHTHALAMIDE) ACID CRUMB

BACKGROUND OF THE INVENTION

1. Field of the Invention

This invention relates to the preparation of stable solutions of the polymerization reaction product, poly(-paraphenylene terephthalamide) acid crumb from which fibrous products can be directly prepared.

2. Description of the Related Art

In the manufacture of poly(paraphenylene terephthalamide) U.S. Pat. No. 4,308,374 issued Dec. 29, 1981 on the application of Vollbracht et al. requires isolating poly(paraphenylene terephthalamide) polymer from the acid crumb reaction product by thoroughly washing the acid crumb to separate the polymer from the organic solvent, the inorganic salts and the hydrogen chloride formed during the reaction. The isolated, washed, and dried poly(paraphenylene terephthalamide) polymer can then be dissolved for example, in accordance with the teachings of U.S. Pat. No. 3,869,429 issued Mar. 4, 1975 on the application of Blades, in concentrated sulfuric acid, to yield a dope from which fibrous products can be produced.

There now has been discovered, through the solvent combination of this invention, a process to prepare stable solutions directly, using poly(paraphenylene terephthalamide) acid crumb, and to make fibrids from these solutions. The solvent combination of this invention permits preparation of a solution of poly(paraphenylene terephthalamide) acid crumb by dissolving the poly(-paraphenylene terephthalamide) acid crumb without the usual steps of isolating, washing and drying the polymer before dissolving the polymer to make the poly(paraphenylene terephthalamide) dope. Furthermore, the solvent combination of this invention eliminates the need for the solvents of the past, such as sulfuric acid, which degrade the polymer, corrode the system components and require costly safety precautions.

U.S. Pat. No. 4,785,038 issued Nov. 15, 1988 on the application of Sweeny addresses the problem of difficultly soluble pure polymers such as, for example, poly(metaphenylene isophthalamide), poly(parabenzamide), and poly(paraphenylene terephthalamide) and teaches a solvent system that obviates the need for such harsh solvents as concentrated sulfuric acid. Clear solutions of such polymers are obtained in a carefully defined mixture of a liquid sulfoxide, base, and alcohol or water. A typical solution from the process taught by Sweeny comprises approximately 88% dimethyl sulfoxide, 5% base, 3% pure polymer and 4% methanol. The process of Sweeny does not yield clear solutions of poly(paraphenylene terephthalamide) acid crumb reaction product at concentrations greater than 2% by weight poly(paraphenylene terephthalamide) which are needed for preparation of fibrids.

SUMMARY OF THE INVENTION

This invention provides a process for preparing a stable liquid solution of poly(paraphenylene terephthalamide) crumb in which process terephthaloyl chloride is placed in reactive contact with para-phenylene diamine in a substantially anhydrous solution of an N-alkyl-pyrrolidone and at least one of a substantially anhydrous alkali-metal salt and alkaline earth metal salt under agitation forces to yield a damp acidic crumb of poly(paraphenylene terephthalamide).

The liquid solution of poly(paraphenylene terephthalamide) crumb is then established under agitating forces; —the solution comprising:

(a) the poly(paraphenylene terephthalamide) crumb reaction product;

(b) a base selected from the group consisting of potassium and sodium hydroxide, and sodium and potassium alkoxides of less than five carbon atoms, the base being present in the amount of from 2.6–5.9 moles per mole of —NH— in the poly(paraphenylene terephthalamide);

(c) a co-solvent of the formula

X—OH wherein X is; H, an alkyl of less than 5 carbon atoms or a combination thereof, the co-solvent being present in the amount of from 10.0–38.0 moles per mole of —NH— in the poly(paraphenylene terephthalamide); and (d) dimethyl sulfoxide present in an amount sufficient to effect solution of the crumb;

Further provided by this invention is a process for manufacturing a fibrous product wherein the stable solution of poly(paraphenylene terephthalamide) crumb is added with vigorous shearing to a liquid precipitation medium to yield fibrids.

DETAILED DESCRIPTION OF THE INVENTION

Poly(paraphenylene terephthalamide), when polymerized by customary processes results in a crumb-like acidic reaction product which includes a relatively low concentration of poly(paraphenylene terephthalamide) polymer and a relatively high concentration of solvent, salt and acid. Until the time of this invention, the crumb could not easily be dissolved. To form poly(paraphenylene terephthalamide) polymer solutions, it was necessary that the polymer first be purified and isolated by vigorously stirring or grinding the crumb with water or aqueous alkali and filtering the polymer slurry. The slurry was then thoroughly washed again and dried before being dissolved in concentrated sulfuric acid and used in the manufacture of fibrous products.

The crumb as used in the process of this invention is conveniently prepared as described in U.S. Pat. No. 3,869,429 and U.S. Pat. No. 4,308,374, and is well known to those skilled in the art. Generally, terephthaloyl chloride is vigorously mixed and placed in reactive contact with para-phenylene diamine in a substantially anhydrous solution of an N-alkyl-pyrrolidone, preferably N-methyl-pyrrolidone, and at least 5% by weight of at least one substantially anhydrous metal salt or alkaline earth metal salt, preferably calcium chloride, based on the total weight of the solution. The crumb reaction product is typically composed of approximately 10–12% poly(paraphenylene terephthalamide) homopolymer, and 88–90% of the product comprises N-alkyl-pyrrolidone, salt and hydrogen chloride formed in the reaction, all of which have been found to interfere with dissolving the poly(paraphenylene terephthalamide).

It has now been found that crumb can be dissolved to yield concentrations of poly(paraphenylene terephthalamide) sufficient for directly forming fibrids in the strong base solvent combination of this invention. The solvent combination of this invention comprises a base, a solvent and a co-solvent.

The crumb to be dissolved, as previously mentioned, includes an amount of hydrochloric acid formed as a result of the polymerization process. Base, includes that amount needed to neutralize the acid in the crumb, is added in the range from 2.6 to 5.9 moles per mole of —NH— in poly(paraphenylene terephthalamide). If the crumb is neutralized prior to the addition of base, the amount of base added to the system is decreased by 1 mole per mole of —NH— in the polymer. Suitable bases are sodium hydroxide and potassium hydroxide, or the potassium and sodium alkoxides of less than five carbon atoms such as potassium tert-butoxide and sodium methoxide. The potassium bases are preferred as they are the stronger bases. Additional base added to the system, generally does not provide any special advantages and may ultimately result in gelation of the system.

The co-solvents suitable in the solvent combination of this invention are of the formula:

X—OH wherein X is; H, an alkyl of less than 5 carbon atoms or a mixture thereof. The co-solvent is present in the range from about 10.0 to 38.0 moles per mole of —NH— in the poly(paraphenylene terephthalamide). The use of additional amounts of co-solvent can decrease the solubility of the crumb.

The solvent, preferably dimethyl sulfoxide, is used in an amount sufficient to effect solution of the crumb in combination with the base and co-solvent. More specifically, solvent is used in a weight approximately equal to the weight of polymer crumb to be dissolved. Example 1 will demonstrate that the ratio of moles of dimethyl sulfoxide present to moles of —NH— in the poly(paraphenylene terephthalamide) should be approximately 15–55. Other solvents can be used such as tetrahydrothiophene oxide.

Temperature is not critical and the process of this invention is generally carried out at room temperature. However, prolonged exposure to increased temperature could result in the degradation of the poly(paraphenylene terephthalamide) polymer.

In the preparation of solutions of crumb using the solvent combination of this invention, the order of addition of the components is generally not critical. The solution is conveniently prepared by pre-dissolving the base in the co-solvent, adding the crumb to the dimethyl sulfoxide and mixing to a slurry, and then combining these two mixtures until a stable solution is formed. Only when the sparingly soluble potassium hydroxide is the base, is it critical to pre-dissolve the base in the co-solvent before the addition of the solvent and crumb.

Solutions prepared by the process of this invention can yield concentrations of greater than 2% by weight of poly(paraphenylene terephthalamide). A typical solution of this invention comprises approximately 40% by weight crumb resulting in a final concentration of approximately 4% poly(paraphenylene terephthalamide), 4% $CaCl_2$, 32% N-methyl-pyrrolidone, 40% dimethyl sulfoxide, 12% methanol and 8% base.

The solutions of this invention are useful in the preparation of poly(paraphenylene fibrids. Poly(paraphenylene terephthalamide) fibrids and paper can conveniently be prepared by adding the solution of this invention directly to a vigorously stirred precipitating medium as described in U.S. Pat. No. 2,999,788 issued Sept. 12, 1961 on the application of Morgan.

Precipitating media for use in preparation of fibrids comprise a nonsolvent for poly(paraphenylene terephthalamide) which is also soluble in the solvent combination of this invention. Precipitating media can, in addition to water, include a variety of polar liquids such as alcohols, amines, amides and ketones such as dimethylacetamide, dimethylformamide, N-methyl pyrrolidone and mixtures thereof.

DESCRIPTION OF THE PREFERRED EMBODIMENTS

EXAMPLE 1

In this example poly(paraphenylene terephthalamide) crumb was prepared by the addition of 1816g of terephthaloyl chloride to a solution of about 44,300g of N-methylpyrrolidone and 3854g of warm dry CaC12 to which 2761g of p-phenylene diamine had been added and stirred together for three hours. The reaction mixture was stirred and 3378g of terephthaloyl chloride was added after cooling the reaction to about 5° C. After kneading and stirring the reaction mass for about one hour at 60° C. the crumb-like reaction product was sieved through a #8 mesh screen to reduce it to small and uniform particle size. 140g of the crumb produced was mixed with 150 g. of dimethyl sulfoxide. To this was added 50 g of methanol in which 28 g of potassium hydroxide had been dissolved. The mixture was stirred for about 10 hours at about 30° C. After standing for an additional 30 hours at room temperature, a clear solution with about 4.0% by weight of poly(paraphenylene terephthalamide) was formed exhibiting a room temperature viscosity of 3330 poise at 0.5 sec-1 shear.

EXAMPLE 2

In this example, poly(paraphenylene terephthalamide) fibrids and paper were prepared from the solution of the previous example. Approximately 10g of the solution were added under vigorous agitation to a blender jar into which had been charged 400 ml N-methyl-pyrrolidone and 100 ml water. The resulting mixture, a dispersion of formed fibrids, was poured onto a glass frit filter across which was a pressure drop. The fibrids were collected as a sheet on the filter, the sheet was removed and dried for 2 hours at 50° C., and was then further dried overnight at room temperature. The paper was pressed with a heated top plate at 100° C. at 150 psi for 2 hours. The resultant paper was pale yellow in color, strong and stiff with a parchment-like hand.

COMPARATIVE EXAMPLE A

As a comparative test, a crumb containing 10.8% poly(paraphenylene terephthalamide) was added to a solution prepared in accordance with the teachings of example 2 in U.S. Pat. No. 4,785,038 in an attempt to prepare a greater than 2% solution of poly(paraphenylene terephthalamide). In U.S. Pat. No. 4,785,038, the base is present in the amount of from 0.4 to 1.6 moles per mole of —NH— in the polymer, an alcohol is present in the amount of from 1 to 5 moles per mole of potassium base, and in the amount of from 1 to 1.5 moles per mole of sodium base or, if water is employed in lieu of alcohol, the water is present in the amount of from 0.5 to 2.5 moles per mole of potassium base and in the amount of from 0.5 to 0.75 moles per mole of sodium base and the liquid sulfoxide being present in an amount sufficient to effect solution. In this example, 30.8 g of crumb was added to a solution of 100ml dimethyl sulfoxide and 9.81 g of potassium tertbutoxide. The mix was allowed to slurry for one half hour and then 6.67 ml of the co-solvent methanol was added. The crumb remained partially undissolved after stirring for more than 48 hours.

COMPARATIVE EXAMPLE B

As a comparative test, a crumb containing 11.1% by weight poly(paraphenylene terephthalamide) was placed in 100% sulfuric acid in a weight ratio of 1:1 at room temperature in an attempt to prepare a 1.20% by weight polymer solution. On mixing, the crumb remained substantially undissolved. Additional concentrated sulfuric acid was added to the mixture until the crumb completely dissolved, yielding a final concentration of only 0.86% by weight polymer solution.

I claim:

1. A process for preparing a stable liquid solution of poly(paraphenylene terephthalamide) crumb comprising the steps of:

(a) placing terephthaloyl chloride in reactive contact with para-phenylene diamine in a substantially anhydrous solution of an N-alkyl-pyrrolidone and at least one of a substantially anhydrous alkali metal salt and alkaline earth metal salt under agitation forces to yield a damp acidic crumb reaction product of poly(paraphenylene terephthalamide); and (b) combining the acidic crumb reaction product, under agitating forces, with:

(i) a base selected from the group consisting of potassium and sodium hydroxide, and potassium and sodium alkoxide of less than five carbon atoms, the base being present in the amount of from 2.6–5.9 moles per mole of —NH— in the poly(paraphenylene terephthalamide);

(ii) a co-solvent of the formula

X—OH wherein X is; H, an alkyl of less than 5 carbon atoms or a combination thereof, the co-solvent being present in the amount of from 10.0–38.0 moles per mole of —NH— in the poly(paraphenylene terephthalamide); and (iii) dimethyl sulfoxide being present in an amount sufficient to effect solution of the poly(paraphenylene terephthalamide) crumb; to yield the stable liquid solution.

2. The solution of claim 1 wherein the base is potassium hydroxide.

3. The solution of claim 1 wherein the co-solvent is methanol.

4. The solution of claim 1 wherein the N-alkyl-pyrrolidone is N-methyl-pyrrolidone.

5. The process of claim 1 wherein the alkali metal salt and alkaline earth metal salt is calcium chloride.

6. The process of claim 1 wherein the final concentration of poly(paraphenylene terephthalamide) is greater than 2%.

7. A process to make the solution of claim 2 comprising the steps of:

(a) predissolving the potassium hydroxide in the co-solvent;

(b) adding the poly(paraphenylene terephthalamide) crumb to the dimethyl sulfoxide and mix to a slurry;

(c) combining the mixtures of steps (a) and (b) and agitating the combination until the stable solution is formed.

8. A process for manufacturing fibrids utilizing the solution of claim 1 in which process the stable solution of poly(paraphenylene terephthalamide) crumb is added to a vigorously stirred precipitation medium and the formed fibrids are filtered from the reaction medium.

* * * * *